US005536198A

United States Patent [19]

Grissom et al.

[11] Patent Number: 5,536,198

[45] Date of Patent: Jul. 16, 1996

[54] APPARATUS AND METHOD FOR ON-SITE DRESSING AND TRUING OF SANDING MACHINE RUBBER-COVERED CYLINDERS

[75] Inventors: Scott D. Grissom, Trinity; Michael C. Grissom, Archdale, both of N.C.

[73] Assignee: Costa & Grissom Machinery Co., Inc., Archdale, N.C.

[21] Appl. No.: 516,231

[22] Filed: Aug. 17, 1995

[51] Int. Cl.[6] ..... B24B 1/00

[52] U.S. Cl. ..... 451/49; 451/426; 451/173

[58] Field of Search ..... 451/57, 426, 427, 451/424, 164, 173, 72, 443, 49, 51, 172, 165

[56] References Cited

U.S. PATENT DOCUMENTS

| | | | |
|---|---|---|---|
| 1,888,589 | 11/1932 | Egnor | 451/173 |
| 2,432,863 | 12/1947 | Dechau | 451/427 |
| 3,952,457 | 4/1976 | Gutierrez | 451/172 |
| 4,573,289 | 3/1986 | Wieck | 451/173 |
| 4,841,675 | 6/1989 | Perneczky | 451/173 |
| 5,060,423 | 10/1991 | Klotz | 451/49 |
| 5,245,793 | 9/1993 | Schmitz | 451/49 |

*Primary Examiner*—Bruce M. Kisliuk
*Assistant Examiner*—Andrew Weinberg
*Attorney, Agent, or Firm*—Richard E. Jenkins

[57] ABSTRACT

An apparatus and method for on-site dressing and truing of rubber-covered cylinders mounted within sanding machines. The grinding apparatus comprises a base having a pneumatic cylinder mounted thereon for imparting oscillating or reciprocating movement to an abrasive plate which extends back and forth along the length of the rubber-covered cylinder during the dressing and truing procedure. The grinding apparatus removes the necessary amount of rubber compound from the rubber-covered cylinder upon which it acts until the rubber-covered cylinder is perfectly round, and the grinding apparatus is then removed from the sanding machine. In this fashion, the apparatus and method of the invention provide for on-site dressing and truing of rubber-covered cylinders of sanding machines without the necessity for conventional removal of the rubber-covered cylinders for dressing and truing.

20 Claims, 4 Drawing Sheets

APPARATUS AND METHOD FOR ON-SITE DRESSING AND TRUING OF SANDING MACHINE RUBBER-COVERED CYLINDERS

TECHNICAL FIELD

The present invention relates to dressing and truing of rubber-covered cylinders used in the sanding heads of sanding machines, and more particularly to an apparatus and method for on-site dressing and truing of rubber-covered cylinders used in the sanding heads of sanding machines.

RELATED ART

Sanding operations that require surface preparation by removing large amounts of materials, scuffing and/or smoothing of the surface are accomplished with industrial sanding machines. These machines can be used on wood products, finishing materials (paints, stains, lacquer sealer, acrylics, polyesters and the like), metals, plastics, resinous materials, hard-surface materials and other types of products that require surface preparation. As is well known in the art, large automated industrial sanding machines (such as the COSTA Model 7570 manufactured by Costa Levigatrici S.p.a.) are used for many of these applications when large scale sanding requirements must be met.

The thickness of the material to be processed will vary and thus require the sanding machine to have one of the two following types of thickness adjustments:

1. a fixed feed table with the top portion of the machine containing the working or sanding units adjusting to the varying thickness by raising and lowering; or
2. the top portion of the sanding machine is fixed and the feed table adjusts for varying material thicknesses by raising and lowering.

Both types of machines are well known, and in either instance the thickness adjustment is either manual by turning or cranking a hand wheel, or automatic by the use of an electric motor for raising and lowering the sanding units or feed table. Also, machines utilizing an automatic raising and lowering mechanism may utilize a handwheel for smaller or micro-adjustments as necessary.

The sanding process requires that the material to be sanded is placed on a flat conveyor belt or track system located on the feed table of the sanding machine, and then horizontally travel under a predetermined number of sanding units at a predetermined linear conveyor material feeding speed. Although many machines utilize the aforementioned automatic feeding system, some sanding machines do not provide a conveyor or track system, and with these machines the feeding system is manual and requires an operator to push the material by hand under the working or sanding unit (or units).

Regardless of the type of automated sanding machine, the working or sanding units utilized comprise a rubber-covered cylinder or drum around which the an abrasive sanding belt is entrained so that the sanding belt and rubber-covered cylinder act to remove a desired amount of material from the product being acted upon. Each rubber-covered cylinder or drum unit is covered by a different rubber hardness (having a different durometer reading) for each sequential and individual sanding unit provided in the upper portion of the mechanized sanding machine.

With an understanding of the state-of-the-art mechanized sanding machine described hereinabove, it will be appreciated that every wide belt sanding operator, maintenance mechanic and service engineer knows that over a period of time (depending upon the hardness of the rubber covering the cylinder) the rubber layer of the rubber-covered cylinder becomes worn and will cause imperfections on a product surface during the sanding operation. The wear and tear to the rubber surface of the rubber-covered cylinder can be due to abrasive belt tracking that tends to groove the rubber, applying too much downward pressure that tends to cause uneven deflection of the rubber, or the abrasive belt breaking and causing a gash in the rubber surface of the rubber-covered cylinder. Regardless, after a period of sustained use, the rubber-covered cylinders of the sanding units must be dressed and then trued until each is once again perfectly round and capable of properly finishing a product surface during the sanding operation. Also, by the time the rubber cover on the rubber-covered cylinder has become worn, the rubber-covered cylinders and/or the feed table may not be perfectly level to each other.

The known procedure used today for dressing and truing each rubber-covered cylinder of a mechanized sanding machine of the type described herein is to totally remove each cylinder requiring maintenance from the sanding machine, ship the cylinders to an outside source (normally the rubber-covered cylinder manufacturer) for dressing and truing on lathe or the like, and then (when the cylinders are returned) again mounting the cylinders in the sanding machine. The shortcoming of this procedure is the significant period of time during which the sanding machine is not operational which results in both a loss in production time and a resulting loss in profits normally derived from the sanding machine.

Applicants have developed a method and apparatus to meet the long-felt need for a system to dress and true the rubber-covered cylinders of a sanding machine without removing them from the machine. Applicants' system allows the sanding machine operator, maintenance mechanic or service engineer to perform the dressing and truing operation on the rubber-covered cylinders not only on-site at the sanding manufacturing facility but actually on-site within the sanding machine itself. The present invention eliminates the necessity to remove the rubber-covered cylinders from a sanding machine for dressing and truing.

More specifically, the primary purpose of the present invention is to permit a sanding machine operator, maintenance mechanic or service engineer to accurately dress and true each rubber-covered cylinder inside of a mechanized sanding machine, regardless of the thickness adjustment system utilized by the sanding machine and regardless of whether or not the table or rubber-covered cylinder is initially level. Applicants' invention is applicable to all known diameters of rubber-covered sanding machine cylinders, to all known widths of sanding machines, and to all types of sanding machines of the general type described herein. Moreover, the invention may be utilized on rubber-covered sanding machine cylinders having any level of rubber hardness and durometer reading.

DISCLOSURE OF THE INVENTION

In accordance with the present invention, there is provided an apparatus for on-site dressing and truing of the rubber-covered cylinders of a sanding machine of the type having a lower horizontal conveyor feed unit and a plurality of sequentially arranged and transversely extending sanding units positioned thereabove. The apparatus comprises a longitudinal base that is positioned beneath and in longitudinal alignment with a selected one of the rubber-covered cylinders of a sanding machine to be acted upon. A trolley having a planar abrasive element mounted thereon is mounted on the longitudinal base and adapted for reciprocating movement along the length of the base. Actuator means associated with the base are provided for imparting reciprocating movement to the trolley and planar abrasive element, and leveling means are operatively associated with the base for leveling the longitudinal base relative to the cylinder to be dressed and trued. In this fashion, each of the one or more the rubber-covered cylinders of a sanding machine can be dressed and trued while remaining in place inside the sanding machine.

Also, in accordance with the present invention, applicant provides a method for on-site dressing and truing of the rubber-covered cylinders of a sanding machine of the type having a lower horizonal conveyor feed unit and a plurality of sequentially arranged and transversely extending rubber-covered cylinders positioned thereabove wherein the conveyor feed unit and the rubber-covered cylinders are adapted for selective vertical movement toward and away from each other. The method comprises positioning a linearly reciprocal grinding apparatus on the conveyor feed unit so that the linearly reciprocating pathway of the grinding apparatus is beneath and parallel to the longitudinal axis of a selected one of the rubber-covered cylinders of the sanding machine. The next step is vertically movably adjusting the conveyor feed unit and the rubber-covered cylinder so that the rubber-covered cylinder is brought into contact with the dressing and truing apparatus positioned on the conveyor feed belt. Next, the method comprises actuating the rubber-covered cylinder and the dressing and truing apparatus so that the dressing and truing apparatus initiates linearly reciprocating movement across the width of the rotating rubber-covered cylinder so as to remove rubber therefrom and thereby dress and true the cylinder. In this manner, the rubber-covered cylinders of a mechanized sanding machine of the type described herein can each be dressed and trued while remaining in place inside the sanding machine.

It is therefore an object of the present invention to provide an apparatus for dressing and truing the rubber-covered cylinders of a sanding machine on-site and without removing the cylinders from the sanding machine.

It is another object of the present invention to provide a process for dressing and truing the rubber-covered cylinders of a sanding machine on-site and while the rubber-covered cylinders remain in place inside the sanding machine.

It is still another object of the present invention to provide an apparatus and method for reducing down time and costs associated with dressing and truing of the rubber-covered cylinders of a sanding machine so as to maximize use time and profits associated with the machine.

Some of the objects of the invention having been stated, other objects will become evident as the description proceeds, when taken in connection with the accompanying drawings described hereinbelow.

BEST MODE FOR CARRYING OUT THE INVENTION

Figure 1:
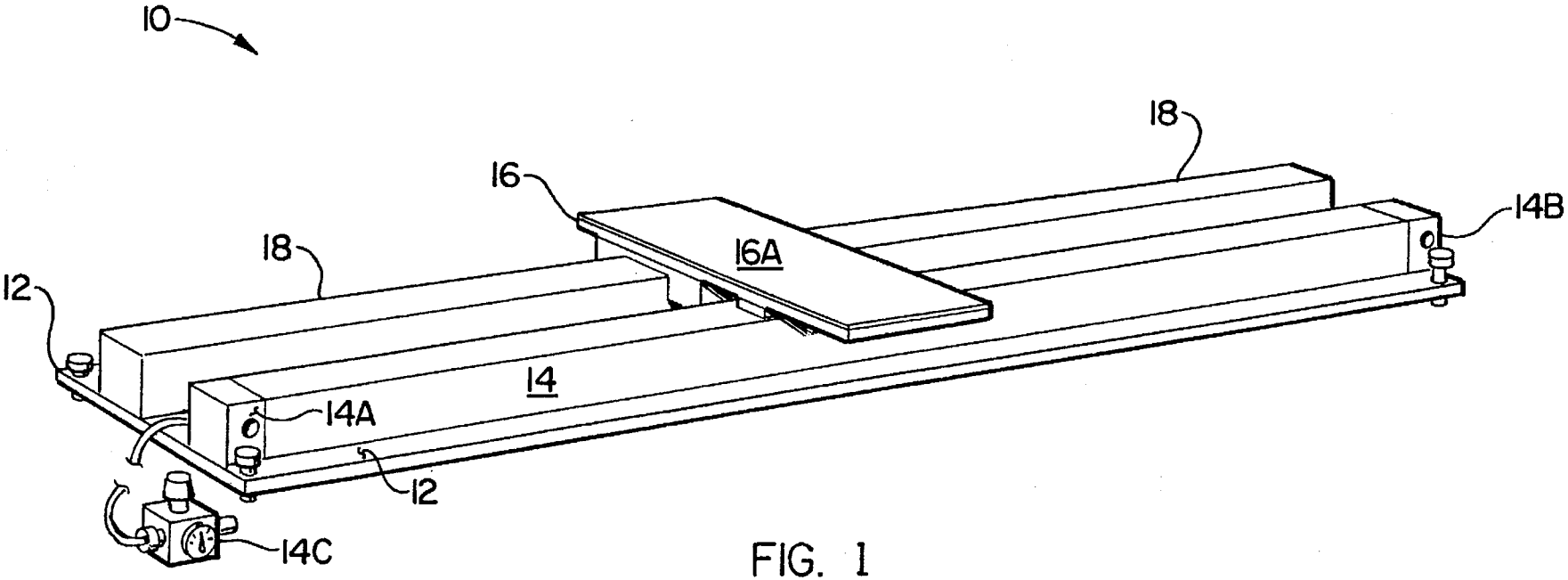
FIG. 1 is a perspective view of the inventive apparatus for on-site dressing and truing of the rubber-covered cylinders or a mechanized sanding machine.
Figure 2:
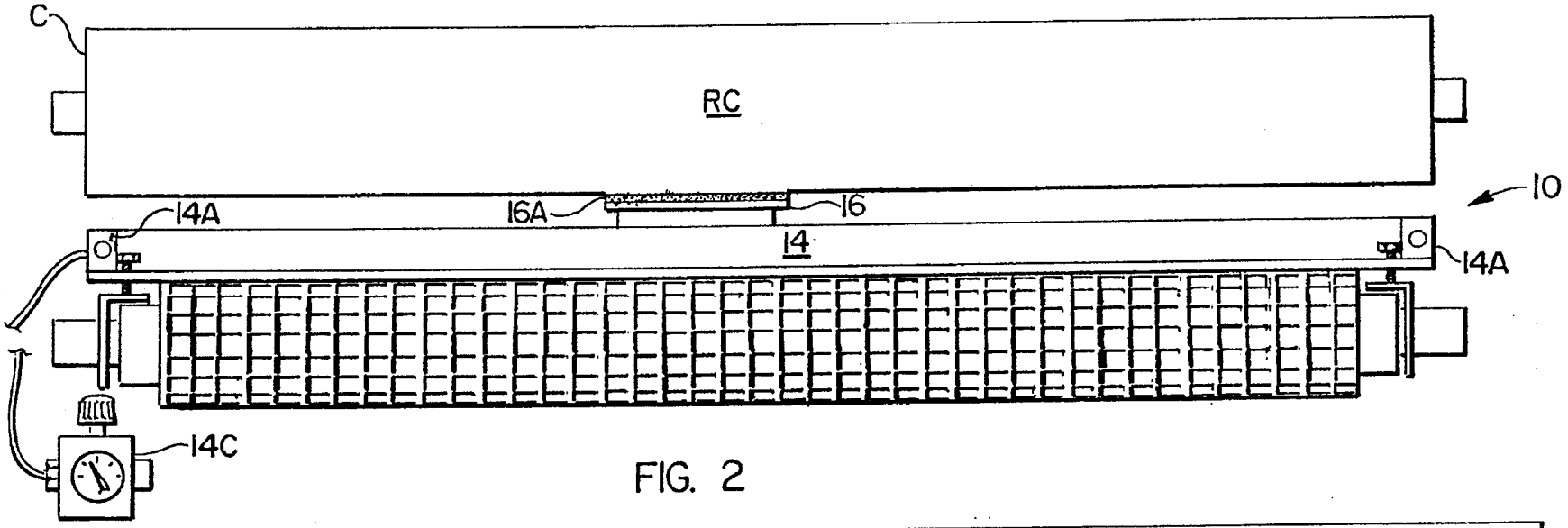
FIG. 2 is a vertical cross-sectional view showing the apparatus of the present invention in place between the conveyor feed unit and a rubber-covered cylinder of a sanding machine.
Figure 3:
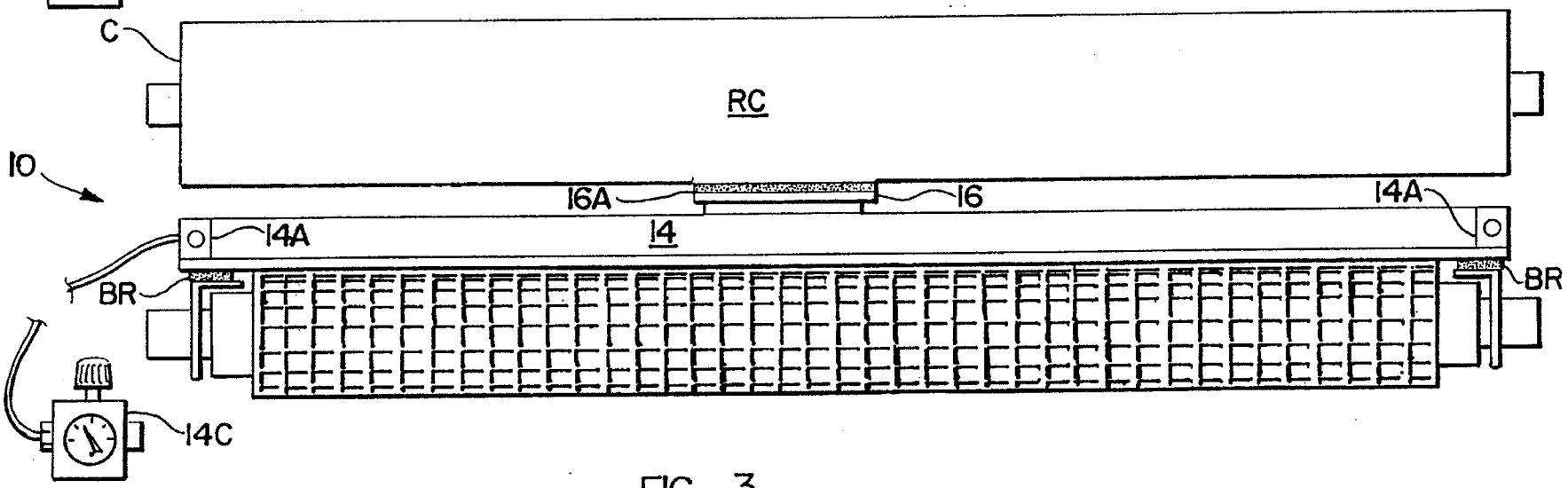
FIG. 3 is a view similar to FIG. 2 but wherein the apparatus has been mounted on a pair of steel blocks on the conveyor feed unit (when the conveyor feed belt is not flat and/or there are visual defects within the conveyor feed belt) to assure that the oscillating linear grinding surface of the dressing and truing apparatus is precisely parallel to the longitudinal axis of the rubber-covered cylinder positioned thereabove.

Referring now to FIGS. 1–5 of the drawings, applicants' linearly oscillating grinder for dressing and truing rubber-covered cylinders of sanding machines is shown and generally designated 10. As is discussed herein, grinding apparatus 10 is intended for use in dressing and truing the rubber-covered cylinders without requiring removal of the cylinders from the sanding machine. Although grinding apparatus 10 may be used with many different types of automated sanding machines of the type having a plurality of sanding units positioned above a support surface upon which a material to be sanded is supported, applicant particularly notes that the present invention lends itself well for use on COSTA Levigatrici sanding machines manufactured by Costa Levigatrici S.p.a. of Italy. More particularly, grinding apparatus 10 lends itself well to use with Model Nos. 60, 70, 80 and 90 Costa Levigatrici automated sanding machines as well as many other brands and models of sanding machines.

Grinding apparatus 10 comprises a flat base 12 which is most suitably of a size approximately equal to the length and somewhat wider than the rubber-covered cylinders to be acted upon. A double-acting pneumatic cylinder 14 is mounted in the lengthwise direction adjacent one side of base 12. Pneumatic cylinder 14 is most suitably an ORIGA Brand, Model No. 210/20, double-action pneumatic cylinder although other similar pneumatic cylinders can be used as a matter of design choice. A trolley 16 is connected directly to pneumatic cylinder 14 so as to be linearly reciprocated substantially along the length of base 12 by pneumatic cylinder 14. Trolley 16 carries an abrasive plate 16A on the top surface thereof which is caused to linearly oscillate or reciprocate the entire width of a rubber-covered cylinder to be dressed and trued by apparatus 10. Apparatus 10 is intended to be provided with a variety of interchangeable abrasive plates 16A which utilize different varieties and grades of abrasive grits to insure that all compositions, compounds and hardnesses of rubber-covered cylinders to be dressed and trued can be operated upon by the present invention.

Figure 4:
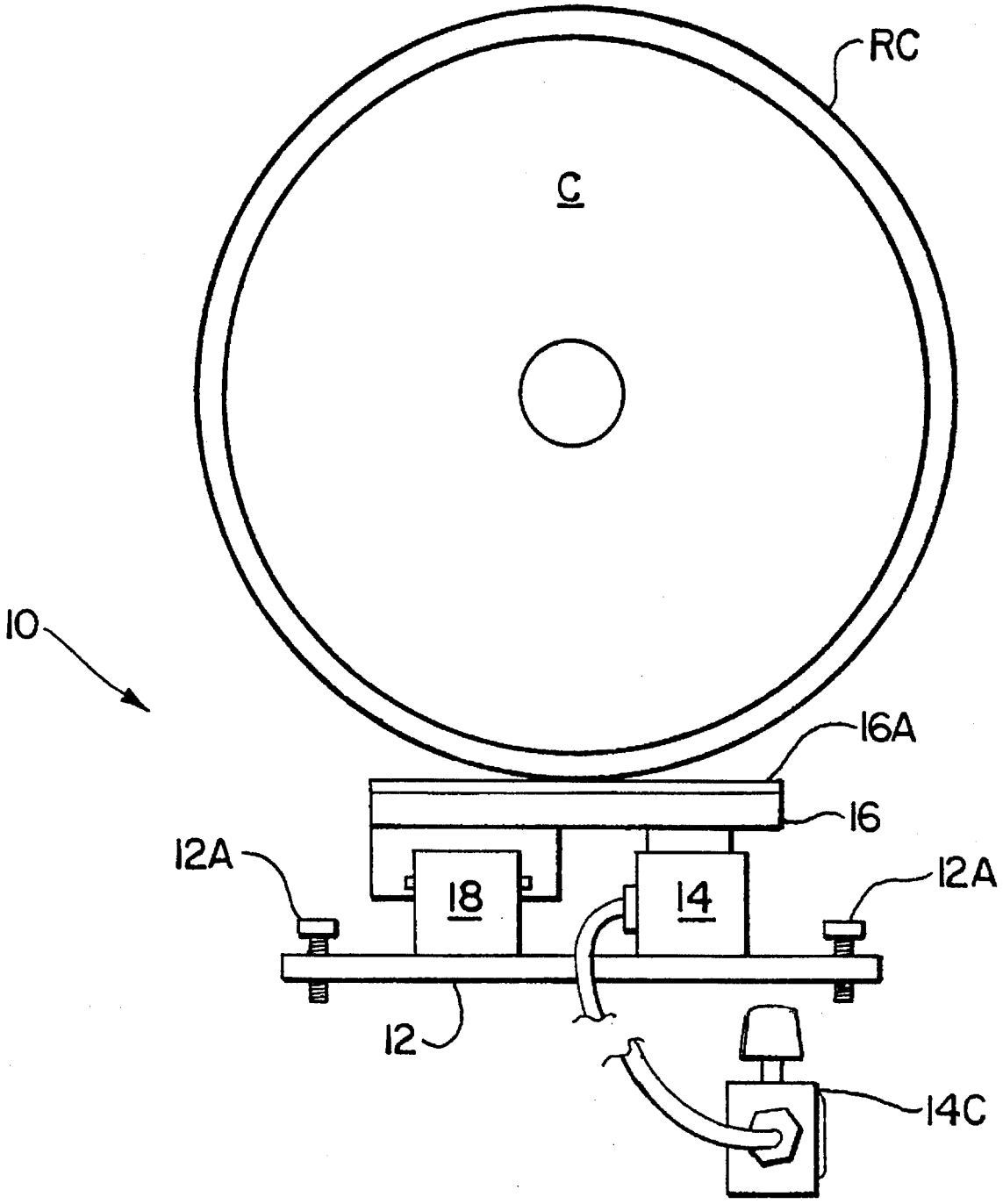
FIG. 4 is a side elevation view of the apparatus of the invention with the linearly oscillating grinding surface in contact with the surface of a rubber-covered cylinder of a mechanized sanding machine.
Figure 5:
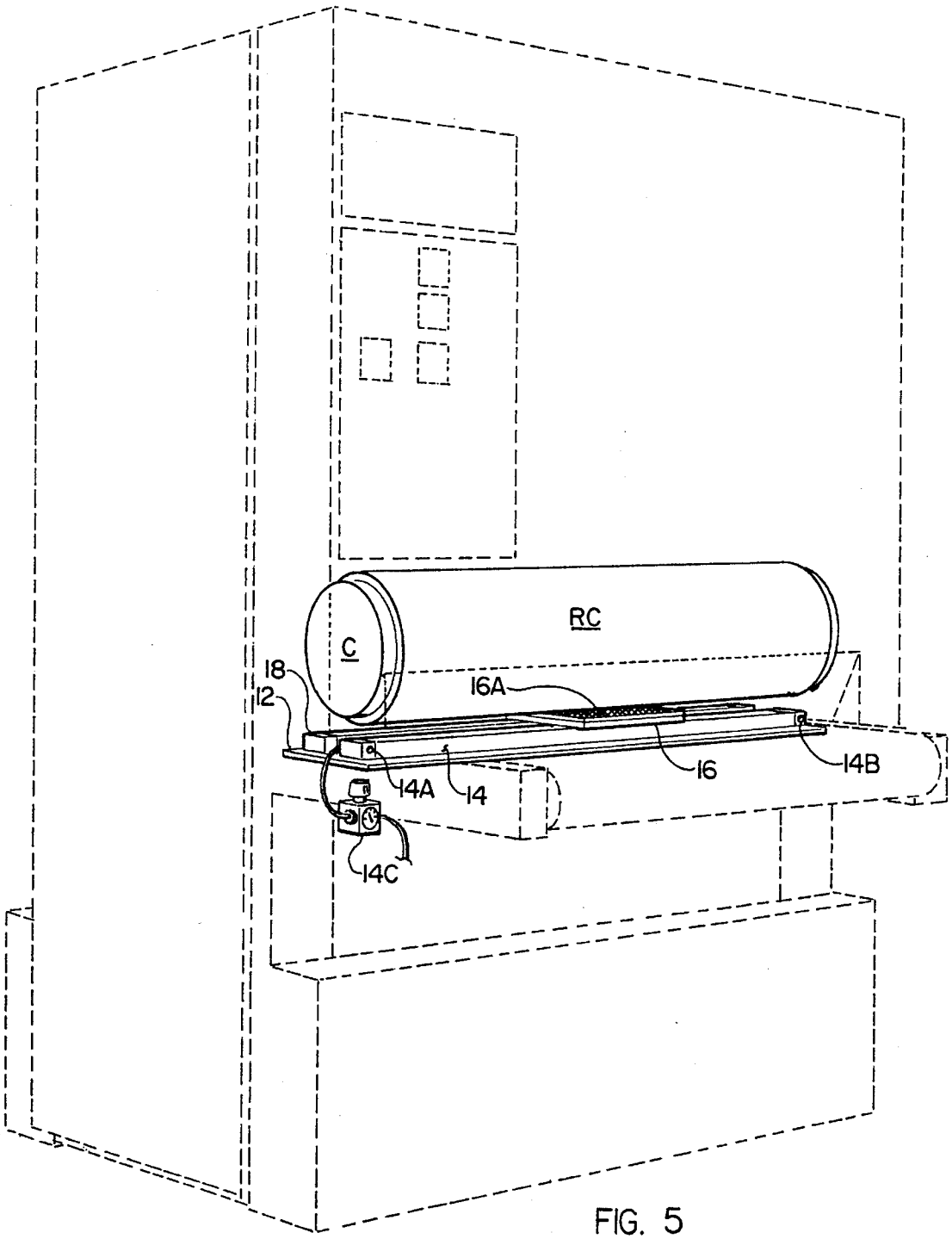
FIG. 5 is a perspective view showing the dressing and truing apparatus of the invention in position inside of a mechanized grinding machine (shown in phantom lines) so as to dress and true one of the rubber-covered cylinders (the remaining cylinders are not shown for purposes of clarity) of the sanding units thereof without requiring removal of the rubber-covered cylinder from the grinding machine.

Also, it can be appreciated with particular reference to FIGS. 1 and 4 of the drawings, trolley 16 is mounted on a linear bearing guide 18 to insure that there is no deflection of abrasive plate 16A during oscillation or reciprocation thereof by pneumatic cylinder 14. Linear bearing guide 18 is mounted on base 12 in spaced-apart and parallel relationship to pneumatic cylinder 14 and is substantially the same width as pneumatic cylinder 14. Applicants contemplate that many different types of linear bearing guides in addition to that depicted in the drawings could be successfully utilized in constructing grinding apparatus 10.

Double-acting pneumatic cylinder 14 is actuated by compressed air as is well known to one familiar with pneumatic cylinders. A flow control valve 14A, 14B is located at each end of pneumatic cylinder 14 to regulate the linear oscillation or reciprocation of trolley 16 to provide a smooth forward and backward stroking action to trolley 16 and abrasive plate 16A carried by trolley 16. Pneumatic cylinder 14 is connected to a compressed air source by pneumatic regulator 14C which is fluidly connected to pneumatic cylinder 14 by conventional air lines.

Applicant has discovered that prior to installing grinding apparatus 10 inside of a sanding machine so as to dress and true the rubber-covered cylinders thereof, each rubber-covered cylinder or drum C must be checked to insure that it is level from side to side, and a measuring device such as a dial indicator gauge is used to do so by mounting the dial indicator gauge onto a flat steel base and using the sanding machine feed table as a reference point to determine whether cylinder C is level. Due to the normal wear and tear of the vertical adjustment mechanisms of the sanding machine feed table or, depending on the type of sanding machine being used, the top portion containing the sanding units of the sanding machine, the positioning of the feed table may become out of level to rubber-covered cylinder C or the top sanding unit portion of a sanding machine may become out of level to the fixed feed table. In either case, oscillating or reciprocating grinding apparatus 10 must be made perfectly level to the positioning of rubber-covered cylinder C prior to initiating the dressing or truing procedure to insure that rubber-covered cylinder C is perfectly dressed or trued from end to end.

In order to facilitate the leveling procedure, base 12 of grinding apparatus 10 is provided at both ends with a pair of leveling screws 12A which will allow the user to level oscillating linear grinding apparatus 10 to the position of rubber-covered cylinder C so that both are perfectly parallel one to the other. Once grinding apparatus 10 has been properly positioned beneath and leveled with a rubber-covered cylinder 0 to be treated, a suitable interchangeable abrasive plate 16A with the desired sanding grid is then attached to trolley 16 by suitable means such as screws or the like (not shown). Thereafter, grinding apparatus 10 is utilized in a method to be described hereinbelow in order to dress and true rubber covering RC of rubber-covered cylinder C to overcome imperfections in rubber covering RC that have developed during sustained use of the sanding machine in which the cylinder is incorporated.

In use, grinding apparatus 10 would be positioned on the conveyor feed unit or the like of a sanding machine so as to extend parallel with rubber-covered cylinder C. In this configuration, the oscillation or reciprocation of trolley 16 will extend along a pathway parallel to the width of cylinder C and transversely to the direction of the conveyor feed belt of the sanding machine. If the conveyor feed belt is not flat or if there are visual defects within the belt to prevent a level relationship between apparatus 10 and cylinder C, applicant has also provided two steel blocks or bridges BR (see FIG. 3) which are adapted to be positioned adjacent each opposing side of the conveyor belt and grinding apparatus 10 then positioned thereon. Base 12 of grinding apparatus 10 has been suitably machined (not shown) so as to mate with the two bridges BR if their use is necessary for the reasons described hereinabove. Also, leveling screws 12A may be utilized as needed and as described above in order to assure a perfectly level and parallel relationship between grinding apparatus 10 and cylinder C.

After grinding apparatus 10 has been placed under a selected rubber-covered cylinder C, cylinder C must be lowered or conveyor feed unit must be raised (depending upon the type of sanding machine) until contact is made between rubber-covered cylinder C and abrasive plate 16A. Cylinder C should contact abrasive plate 16A directly in the center of the plate so that the pressure from the actual grinding is distributed throughout double-acting pneumatic cylinder 14 and linear guide 18.

Next, rubber-covered cylinder C is actuated to initiate rotating movement by means of the sanding machine start switch. Then the compressed air source is connected to pneumatic regulator 14C of pneumatic cylinder 14 so that trolley 16 and abrasive plate 16A thereon initiate the oscillating or reciprocating movement. As abrasive plate 16A oscillates back and forth along the length of apparatus 10 and the width of rubber-covered cylinder C, a selected amount of rubber is removed from rubber covering RC of cylinder C in selected amounts that may be measured in either thousandths of an inch or larger, depending on the grit of abrasive plate 16A and the amount of rubber necessary to be removed for proper dressing and truing of cylinder C. The oscillation or reciprocation of abrasive plate 16A reduces friction and eliminates heat build-up between abrasive plate 16A and cylinder C. The reciprocating movement of grinding apparatus 10 provides a true grinding or honing effect to rubber-covered cylinder C, and the oscillation and honing should be continued until the desired amount of rubber is removed and rubber-covered cylinder C is perfectly round. At this time, grinding apparatus 10 is moved beneath each additional cylinder C requiring dressing and truing, and removed once original cylinder C and any additional cylinders requiring dressing and truing have been properly acted upon.

It will be understood that various details of the invention may be changed without departing from the scope of the invention. Furthermore, the foregoing description is for the purpose of illustration only, and not for the purpose of limitation—the invention being defined by the claims.

What is claimed is:

1. An apparatus for on-site dressing and truing of the rubber-covered cylinders of a sanding machine of the type having a lower horizontal conveyor feed unit and a plurality of sequentially arranged and transversely extending sanding units positioned thereabove, said apparatus comprising:

(a) a longitudinal base adapted to be positioned beneath and in longitudinal alignment with a selected one of the rubber-covered cylinders of a sanding machine;

(b) a trolley having a planar abrasive element mounted thereon and adapted for reciprocating movement along the length of said longitudinal base;

(c) actuator means associated with said base for imparting reciprocating movement to said trolley; and (d) leveling means operatively associated with said base for leveling said longitudinal base relative to the cylinder to be dressed and trued;

whereby the rubber-covered cylinders of the sanding machine can be dressed and trued while remaining in place inside the sanding machine.

2. An apparatus according to claim 1 wherein said longitudinal base includes a linear bearing guide extending the length of said base and operatively engaged by said trolley during its reciprocating movement.

3. An apparatus according to claim 2 wherein said longitudinal base is adapted to be positioned beneath and in coextensive longitudinal alignment with the rubber-covered cylinders during dressing and truing thereof.

4. An apparatus according to claim 1 wherein said planar abrasive element of said trolley comprises a removable and interchangeable abrasive plate.

5. An apparatus according to claim 1 wherein said actuator means comprises a double-acting pneumatic cylinder operatively connected to said trolley.

6. An apparatus according to claim 5 wherein said double-acting pneumatic cylinder includes a pair of flow control valves operatively connected thereto to regulate the reciprocating motion of said double-acting pneumatic cylinder.

7. An apparatus according to claim 5 wherein said double-acting pneumatic cylinder includes a pneumatic regulator in pneumatic connection therewith for fluidly connecting a compressed air source to said pneumatic cylinder.

8. An apparatus according to claim 1 wherein said leveling means comprises a plurality of leveling screws.

9. In combinating a sanding machine of the type having a lower horizontal conveyor feed unit and a plurality of sequentially arranged and transversely extending rubber-covered sanding cylinders positioned thereabove, and an apparatus for on-site dressing and truing of the rubber-covered sanding cylinders, said apparatus comprising:

(a) a longitudinal base adapted to be positioned beneath and in longitudinal alignment with a selected one of the rubber-covered cylinders of a sanding machine;

(b) a trolley having a planar abrasive element mounted thereon and adapted for reciprocating movement along the length of said longitudinal base;

(c) actuator means associated with said base for imparting reciprocating movement to said trolley; and (d) leveling means operatively associated with said base for leveling said longitudinal base relative to the cylinder to be dressed and trued;

whereby the rubber-covered cylinders of the sanding machine can be dressed and trued while remaining in place inside the sanding machine.

10. An apparatus according to claim 9 wherein said longitudinal base includes a linear bearing guide extending the length of said base and operatively engaged by said trolley during its reciprocating movement.

11. An apparatus according to claim 10 wherein said longitudinal base is adapted to be positioned beneath and in coextensive longitudinal alignment with the rubber-covered cylinders during dressing and truing thereof.

12. An apparatus according to claim 9 wherein said planar abrasive element of said trolley comprises a removable and interchangeable abrasive plate.

13. An apparatus according to claim 9 wherein said actuator means comprises a double-acting pneumatic cylinder operatively connected to said trolley.

14. An apparatus according to claim 13 wherein said double-acting pneumatic cylinder includes a pair of flow control valves operatively connected thereto to regulate the reciprocating motion of said double acting pneumatic cylinder.

15. An apparatus according to claim 13 wherein said double-acting pneumatic cylinder includes a pneumatic regulator in pneumatic connection therewith for fluidly connecting a compressed air source to said pneumatic cylinder.

16. An apparatus according to claim 9 wherein said leveling means comprises a plurality of leveling screws.

17. A method for on-site dressing and truing of the rubber-covered cylinders of a sanding machine of the type having a lower horizontal conveyor feed unit and a plurality of sequentially arranged and transversely extending rubber-covered cylinders positioned thereabove, said conveyor feed unit and said rubber-covered cylinders being adapted for movement vertically toward and away from each other, said method comprising the steps of:

(a) positioning a linearly reciprocable grinding apparatus on said conveyor feed unit so that the linearly reciprocating pathway of said grinding apparatus is beneath and parallel to the longitudinal axis of a selected one of the rubber-covered cylinders of the sanding machine;

(b) vertically movably adjusting said conveyor feed unit and said rubber-covered cylinder so that said rubber-covered cylinder is brought into contact with said grinding apparatus positioned on said conveyor feed unit; and (c) actuating said rubber-covered cylinder and said grinding apparatus so that said grinding apparatus initiates linearly reciprocating movement across the width of said rotating rubber-covered cylinder so as remove rubber therefrom and thereby dress and true said rubber-covered cylinder;

whereby said rubber-covered cylinders of said sanding machine can be dressed and trued while remaining in place inside said sanding machine.

18. A method according to claim 17 including leveling said grinding apparatus after it is positioned on said conveyor feed unit so that it is in correct level alignment with said rubber-covered cylinder.

19. A method according to claim 17 wherein said vertically movably adjusting comprises lowering said rubber-covered cylinder into contact with said grinding apparatus.

20. A method according to claim 17 wherein said vertically movable adjusting comprises raising said conveyor feed unit so as to bring said grinding apparatus into contact with said rubber-covered cylinder.

* * * * *